United States Patent [19]

Wang

[11] Patent Number: 5,051,728

[45] Date of Patent: Sep. 24, 1991

[54] MUSIC POSTER

[76] Inventor: Frank Y. Wang, 2Fl. No. 30, Lane 545, Tun Hua S. Rd., Taipei, Taiwan

[21] Appl. No.: 484,895

[22] Filed: Feb. 26, 1990

[51] Int. Cl.[5] ..... G08B 23/00

[52] U.S. Cl. ..... 340/573; 40/463; 40/465; 340/309.15; 340/326

[58] Field of Search ..... 340/573, 326, 309.15, 340/331, 555; 40/463, 465, 902; 362/802; 368/10–12, 272, 244, 246, 250; 367/93

[56] References Cited

U.S. PATENT DOCUMENTS

| | | | |
|---|---|---|---|
| 3,631,318 | 12/1971 | Hubbard | 340/331 X |
| 4,023,151 | 5/1977 | Markham | 340/556 X |
| 4,070,698 | 1/1978 | Curtis et al. | 369/3 |
| 4,222,188 | 9/1980 | Tarrant et al. | 40/902 X |
| 4,358,754 | 11/1982 | Young et al. | 40/463 X |
| 4,785,289 | 11/1988 | Chen | 340/309.15 X |
| 4,853,678 | 8/1989 | Bishop, Jr. et al. | 340/573 |

*Primary Examiner*—Glen R. Swann, III
*Assistant Examiner*—Thomas J. Mullen, Jr.
*Attorney, Agent, or Firm*—Morton J. Rosenberg; David I. Klein

[57] ABSTRACT

This invention relates to a music poster which includes a sound generating system disposed in a rectangular case combined with a poster. A PC board assembly includes an insulating board and a conductive minute hand mounted thereon, and is coupled externally to a sound generator and an LED assembly. Responsive to the minute hand passing through a sound operative interval, a variety of musical sounds are generated through the sound generator, and the LED assembly is operative to produce a flashing light effect, simultaneously. When the minute hand reaches and passes through a non-effective interval, the audio-visual operation is stopped immediately. As an alternate form, the PC board assembly is replaced by a photoelectric or acoustic sensor which controls the operation of the sound generator and the LED assembly, so as to let the sound generator and the LED assembly begin to operate when people are detected as passing by the poster, by a change in light levels, or sound.

1 Claim, 3 Drawing Sheets

MUSIC POSTER

BACKGROUND OF THE INVENTION

The present invention is related to a music poster which can audio-visually attract people and induce the interest of customers.

Regular posters, either hung or adhesively mounted indoors or outdoors, such as inside or outside of a car, a train, or any place for that matter, shall only become effective when potential customers are willing to view them. However, at the present time, most people are always in a hurry. As a consequence, people are gradually losing their interest in observing the things occurring around them. Therefore, regular posters have been losing their appeal as a means of inducing the interest of customers. In order to attract people and induce the interest of customers, the structure of the conventional posters must be fundamentally improved.

SUMMARY OF THE INVENTION

The present invention provides a music poster which makes use of the structure of a timepiece which is coupled to a multimusic generator assembly. The timepiece structure includes an electrically conductive minute hand mounted on a PC board assembly for rotation about a notched insulating board, whereby the conductive minute hand makes electrical contact with conductive regions defined within the notched areas of the insulating board.

The electrical connection, thus made, turns on an externally connected LED assembly to produce a flashing light effect, while a variety of musical sounds are produced by a sound generator. The timepiece structure further includes a stop control knob which is mounted on the PC board assembly to stop the operation thereof, when the knob is pulled out. As an alternate form, the PC assembly may be replaced by a photoelectric or acoustic sensor which controls the operation of the sound generator and the LED assembly when it is impinged by light or sound, respectively. The music poster constructed according to the present invention therefore simultaneously produces an audio-visual effect to efficiently attract people and induce the interest of customers.

The features, objects and advantages of the present invention will be apparent from the following detailed description of the preferred embodiment considered in connection with the accompanying drawings wherein:

DETAILED DESCRIPTION OF THE PREFERRED EMBODIMENTS

Figure 1:
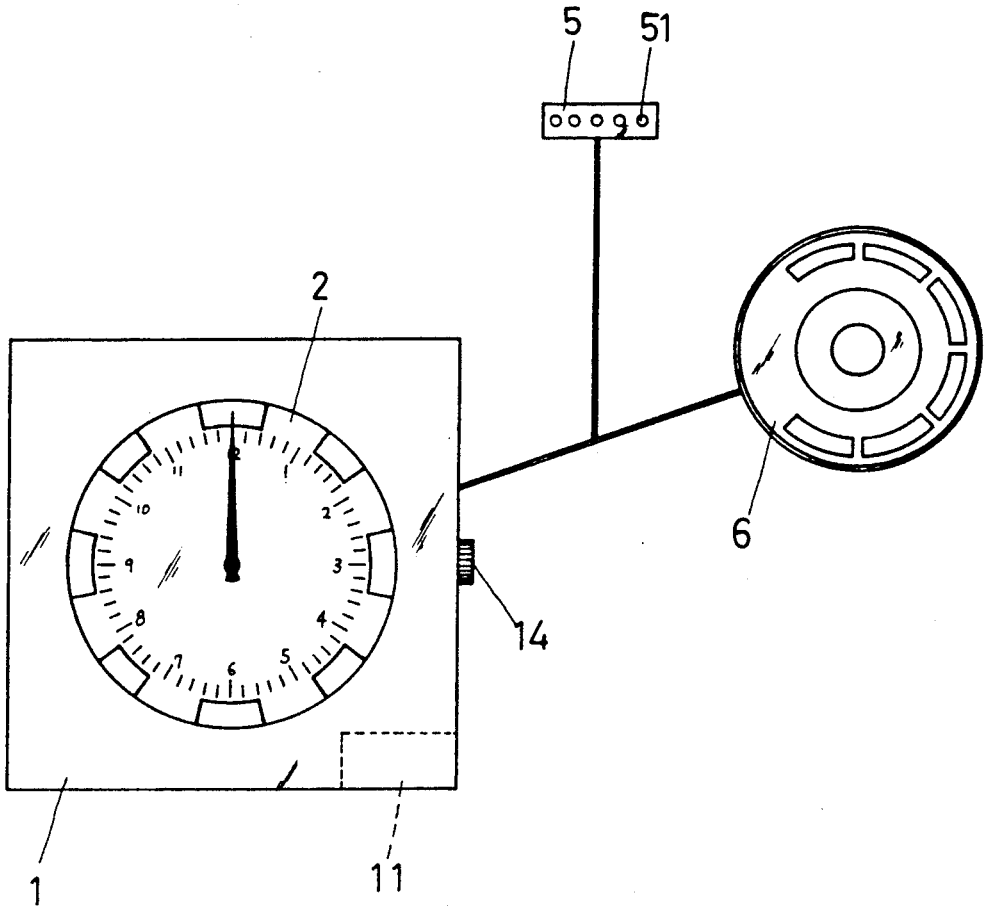
FIG. 1 is a front view of a sound generator assembly according to the present invention.
Figure 2:
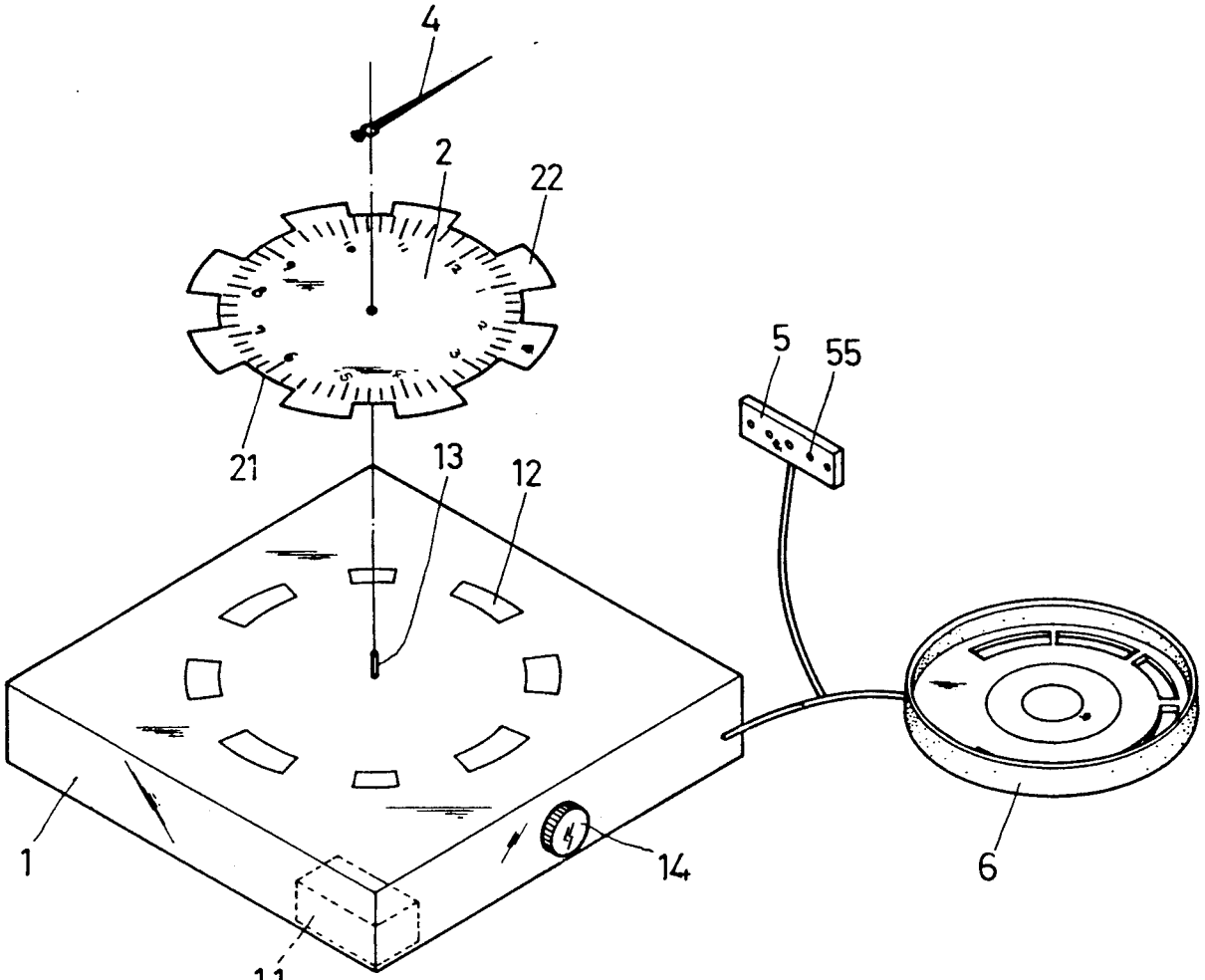
FIG. 2 is a perspective fragmentary view of the sound generator assembly according to the present invention; and, FIGS. 3A and 3B illustrate the application of the sound generator assembly in incorporation with a poster.

With reference to FIGS. 1 and 2, there is shown a sound generating system according to the present invention. The system comprises (a) a PC board assembly (1) including an insulating board (2) and an electrically conductive minute hand (4) respectively mounted thereon, (b) an externally coupled LED assembly (5), and, (c) a sound generator (6) externally connected thereto. The PC board assembly (1) has mounted thereon a variety of music ICs (commercialized products, not shown in the drawing) and a power supply comprising a battery contained within a battery chamber (11). A stop control knob (14) is mounted on the PC assembly (1) for stopping the operation of the PC board assembly (1) when desired.

According to the present invention, the PC board assembly is provided with a plurality of sound operational intervals (12), in which are respectively mounted the variety of music ICs on respective PC boards. The insulating board (2) and the minute hand (4) are respectively mounted on a central timer shaft (13) of the PC board assembly (1). The insulating board (2) includes a plurality of sound effective notches (21) formed therein, the insulating board (2) being disposed on the PC board assembly such that the notches (21) overlay the sound operational intervals (12) of the PC board assembly (1).

The minute hand (4) is a conductive metal pointer. The minute hand (4) is driven to rotate, by means of the central shaft (13) of the timepiece structure, powered by the battery disposed in the battery chamber (11) of the PC board assembly (1). In a manner similar to that of a minute hand of a conventional timepiece, the conductor minute hand (4) will revolve around the face of the insulating board (2). When the minute hand (4) passes through any of the sound operational intervals (12), power is immediately connected through the minute hand (4) to turn on the external sound generator (6) and the lamp bulbs (51) of the LED assembly (5), simultaneously.

In synchronism with the audio frequency generated through the sound generator (6), the lamp bulbs (51) are intermittently turned on and off in a sequence from the center of the display toward both lateral sides, providing a flashing effect. Therefore, the poster into which is incorporated the sound generating system, constructed according to the present invention, simultaneously produces both an audio and visual effect to attract people thereto. When the minute hand (4) reaches and passes through one of the non-effective intervals (22), the sound generator (6) and the LED assembly (5) are automatically turned off. Whenever it is desired to stop the operation of the device, it is achieved by simply pulling out the stop control knob (14). When the stop control knob (14) is again pressed in, the device will immediately resume operation.

As an alternate form, the PC board assembly (1) may be replaced by a photoelectric or acoustic sensor to control the operation of the sound generator (6) and the LED assembly (5). In this embodiment, the sound generator (6) and the LED assembly (5) start to operate when people pass by, as detected by a change in light level or detection or an increased sound level.

Figure 3B:
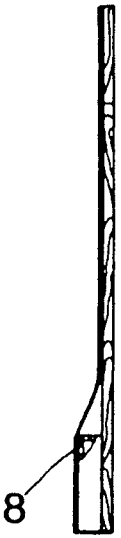
Figure 3A:
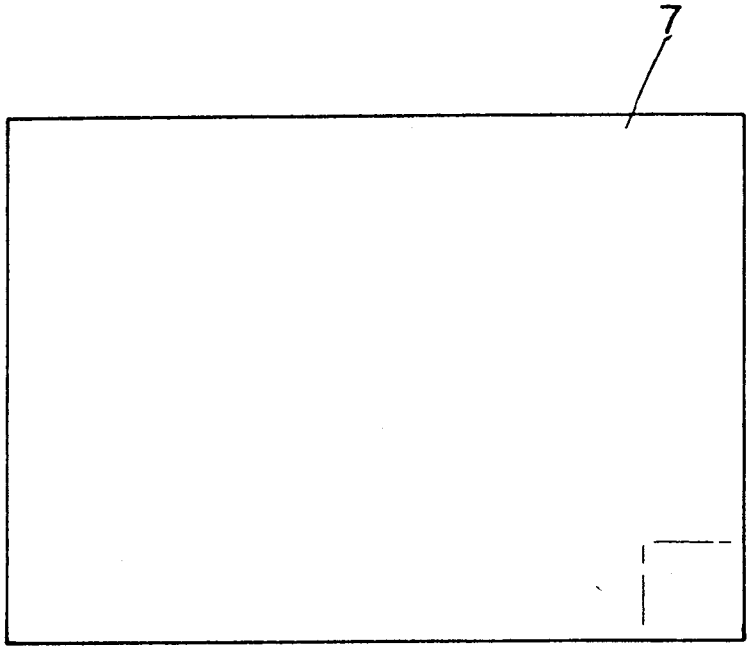

With reference to FIGS. 3A and 3B, the sound generating assembly is disposed in a rectangular case (8), which may be made of paperboard, PVC or acrylic material, with the LED assembly (5) exposed outside of the case. The rectangular case (8) is fixedly coupled to the poster (7) at one corner thereof, thereby forming a music poster. Because the sound generating system of the instant invention is very compact, it does not occupy much space. Therefore, the music poster is suitable for hanging or adhesive mounting to any wall surface, either indoors, outdoors, or inside or outside a car or train, for inducing the interest of customers.

As described above, the present invention is to provide such a music poster which comprises a poster having a sound generating system incorporated therewith, so as to make the structure more practical for attracting people and inducing the interest of customers by virtue of the audio-visual effect.

I claim:

1. A music poster having a battery powered sound generation system for providing simultaneous audio and visual effects, comprising:

a. control means for actuating both said audio and visual effects, said control means including (1) printed circuit board assembly having a plurality of electrically conductive regions formed thereon and separated one from another by a plurality of electrically non-conductive regions, and (2) an electrically conductive member rotatively driven by a timepiece mechanism, whereby said conductive member alternately contacts said conductive and non-conductive regions of said printed circuit board assembly for periodically generating an actuation signal;

b. sound generation means electrically coupled to said control means for generating acoustic signals responsive to said actuation signal; and c. lamp flashing means coupled to said control means for alternately energizing one or more of a plurality of lamps in synchronism with said acoustic signals responsive to said actuation signal.

* * * * *